United States Patent [19]

Breit

[11] 4,384,234

[45] May 17, 1983

[54] SPARK PLUG WITH HEAT CONDUCTING SLEEVE FOR CENTER ELECTRODE

[75] Inventor: Henry F. Breit, Attleboro, Mass.

[73] Assignee: Texas Instruments Incorporated, Dallas, Tex.

[21] Appl. No.: 253,140

[22] Filed: Apr. 13, 1981

Related U.S. Application Data

[63] Continuation of Ser. No. 101,357, Dec. 7, 1979, abandoned, which is a continuation-in-part of Ser. No. 20,112, Mar. 13, 1979, abandoned.

[51] Int. Cl.[3] ..... H01T 13/20

[52] U.S. Cl. ..... 313/142

[58] Field of Search ..... 313/141, 142

[56] References Cited

U.S. PATENT DOCUMENTS

| | | | |
|---|---|---|---|
| 2,197,006 | 4/1940 | Peters et al. | 313/141 X |
| 2,261,436 | 11/1941 | Fanger | 313/142 |
| 2,296,033 | 9/1942 | Heller | 313/141 X |
| 2,615,441 | 10/1952 | Bychinsky | 313/145 X |
| 2,680,432 | 6/1954 | Rand | 313/141 X |
| 2,955,222 | 10/1960 | Beesch | 313/141 |
| 2,988,662 | 6/1961 | Smith | 313/141 X |
| 3,144,576 | 8/1964 | Hagmaier et al. | 313/141 |
| 3,346,760 | 10/1967 | Jalbing et al. | 313/141 X |
| 3,355,795 | 12/1967 | Clark | 29/481 |
| 3,356,882 | 12/1967 | Hallauer et al. | 313/141 |
| 3,548,472 | 12/1970 | Urushiwara et al. | 313/141 X |
| 3,803,892 | 4/1974 | Yamaguchi et al. | 29/25.12 X |
| 3,857,145 | 12/1974 | Yamaguchi et al. | 313/141 X |

FOREIGN PATENT DOCUMENTS

| | | |
|---|---|---|
| 431555 | 7/1935 | United Kingdom . |
| 2024929 | 1/1980 | United Kingdom . |

*Primary Examiner*—Palmer C. Demeo

*Attorney, Agent, or Firm*—John A. Haug; James P. McAndrews; Melvin Sharp

[57] ABSTRACT

A spark plug particularly suitable for use with internal combustion engines includes a center electrode comprising a composite body having a core of metal which has a high degree of corrosion resistance and resistance to arc erosion such as a nickel material metallurgically bonded to a sleeve of metal which has a high degree of thermal conductivity such as a copper material. Specific embodiments relate to difference electrode tip configurations including one in which the copper and nickel are coextensive and others in which the core extends beyond the sleeve. In certain embodiments the copper sleeve is shielded from the combustion chamber by disposing a layer of material, which may be of the same material as the core and may be made integrally therewith or attached thereto, contiguous to the copper material. Extra erosion and corrosion protection can be obtained by providing a thin coating of material around the copper sleeve.

12 Claims, 10 Drawing Figures

SPARK PLUG WITH HEAT CONDUCTING SLEEVE FOR CENTER ELECTRODE

This is a continuation of application Ser. No. 101,357, filed Dec. 7, 1979, now abandoned, which is a continuation in part of application Ser. No. 20,112 filed Mar. 13, 1979, now abandoned.

BACKGROUND OF THE INVENTION

This invention relates to spark plugs and more particularly to spark plugs having improved center electrodes.

Smooth operation of an internal combustion engine is directly related to the condition of the spark plugs used in the engine. Such spark plugs are subjected to intense heat, in a typical four cycle engine the flame temperatures are over 3000° F. as well as the extremely high pressures used to drive the pistons. Additionally, the voltage pulse used to ignite the fuel can be in excess of 30,000 volts at times. Not only must the spark plug withstand these conditions for many thousands of miles but the heat transfer characteristics must be such over the life of the plug that heat will be dissipated evenly from the firing tip to avoid preignition with possible engine damage resulting therefrom.

In general the heat path extending from the tip of the insulator body mounting the center electrode to its point of contact with the shell mounting the spark plug to the cylinder head determines the operating temperature of the spark plug. Heat is transferred to the cylinder head to prevent excessive temperatures which would result in preignition and detonation. On the other hand the operating temperature of the plug must be maintained sufficiently high to prevent carbonizing and eventual short circuiting of the gap.

Thus the length of the heat path as well as the thermal conductivity of the components making up the heat path must be taken into account in designing the spark plug. In general, the longer the heat path, the higher the operating temperature of the plug. Another primary factor to be considered in the plug design is the effects of spark erosion and corrosion. In choosing the material to be used for the center electrode various criteria relating to performance are considered including resistance to corrosion and erosion, electrical resistivity and thermal conductivity as well as criteria relating to manufacturing such as formability, weldability, cost and availability of the raw material. For many years it was conventional to use various special steel alloys for the center electrode however as corrosion became more and more of a problem in automotive engines, these alloys were supplanted by nickel and nickel chrome alloys which are still in wide use today. Nickel material has offered the best compromise for the above criteria for an electrode having a single layer of material; however, such material is more costly than the older steel alloys and the thermal conductivity is not as high as would be desirable. Among the various attempts which have been made to increase the thermal conductivity of the center electrode include the use of high conductivity material, such as copper encased within the nickel material so that the surface of the material has the desirable corrosion and erosion resistance characteristics while the copper enhances heat transfer. Examples of the approach are disclosed in U.S. Pat. Nos. 2,955,222; 3,144,576; 3,356,882; 3,803,892 and 3,857,145. However, this approach has not been widely accepted since such electrodes are relatively expensive to manufacture and the heat transfer characteristics is still not optimum. In higher cost aircraft spark plugs, which are subject to more severe service conditions than most other internal combustion engine applications and in which a higher degree of reliability is desirable it is known to provide a separate sleeve of copper surrounding the center electrode to act as a heat sink. While this construction improves the heat transfer characteristics of the spark plug it is relatively expensive to manufacture since the dimensional tolerances of the diameters of the electrode sleeve and insulator must be held very close to obtain optimum heat transfer therethrough and additional manufacturing steps are required to assemble the parts in fixed relation within the plug.

Accordingly, an objective of the invention is the provision of an internal combustion engine spark plug center electrode which has improved heat transfer characteristics while maintaining acceptable corrosion and erosion characteristics.

Another object is the provision of such an electrode which is inexpensive and readily compatible with current manufacturing techniques.

SUMMARY

Briefly, in accordance with the invention such an electrode is composed of a composite body having a core of metal which has the desirable properties of corrosion and erosion resistance, electrical resistivity and the like such as nickel material, metallurgically bonded to a sleeve of material having very high thermal conductivity, such as copper material. The sleeve is metallurgically bonded to the core as by solid phase bonding in order to optimize heat transfer through the interface of sleeve and core. Specific electrode tip configurations include one in which the core and sleeve are coextensive in length, one in which the sleeve extends only as far as the insulator tip, and others in which a ring of material, either formed integrally with the core or attached thereto, shields the sleeve. Extra erosion and corrosion protection may be provided by coating the sleeve with a thin layer of nickel, or some other corrosion resistant material. In certain embodiments the ring, shown in the form of a headed portion, forms the sparking surface while in others a separate sparking surface is provided.

Other details, uses and advantages of this invention will be readily apparent from the exemplary embodiments thereof presented in the following specifications, claims and drawings.

BRIEF DESCRIPTION OF THE DRAWINGS

The accompanying drawings show several exemplary embodiments of the invention in which:

Referring to FIG. 1 of the drawings numeral 10 refers generally to a spark plug incorporating a center electrode 12 made in accordance with the invention. Spark plug 12 includes a generally cylindrical body portion 14 of electrically insulative, heat resistant material, such as ceramic, formed with a bore 16 extending from a terminal end 18 to a tip end 20. Bore 16 is preferably formed with at least two different radii, as seen at 22 and 24 in order to form a seating portion 26 therebetween which receives center electrode 12 in a selected axial position. Terminal member 28 is received in portion 22 of bore 16 and extends externally of body portion 14 to allow connection with the electrical system associated with the engine. Terminal member 28 is electrically connected to center electrode 12 in a conventional manner as by placing powdered metal such as iron, in a glass binder which also provides a gas tight electrically conductive bond 29 between terminal member 28 and center electrode 12. It will be understood that if it is preferred terminal member 28 and center electrode 12 could be an integral member; however, the seal described is advantageous in preventing compression leakage through the center of the spark plug.

Figure 1:
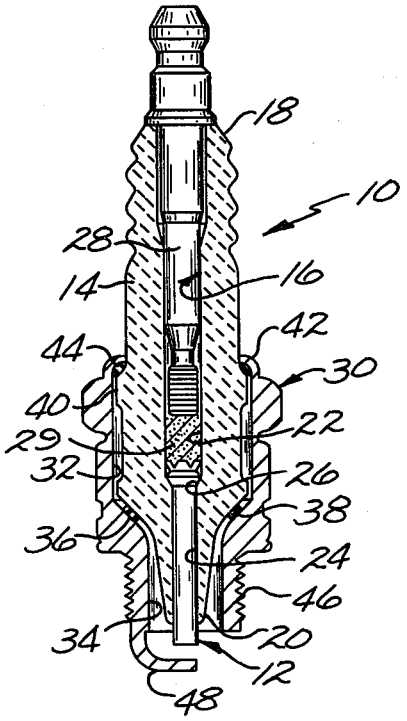
FIG. 1 is a cross sectional view of a typical spark plug incorporating the improved center electrode 12 made in accordance with the invention.

Body portion 14 is received in a generally cylindrical shell 30 of electrically and thermally conductive material, such as steel. Shell 30 is provided with a first, relatively large bore 32 and a second smaller bore 34 joined by seating portion 36. Internal gasket 38 is disposed on seating portion 36 with body portion 14 received thereon. Body portion 14 is provided with an annular flange 40 intermediate the terminal and tip ends to cooperate with lip 42 of shell 30 which is turned over to securely maintain body 14 tightly seated therewithin. A gasket 44 is preferably placed between flange 40 and lip 42 to prevent undue shock and compression forces to be transferred to the ceramic material of body 14. Shell 30 is threaded at 46 to permit attachment to the cylinder head of the engine. A side electrode is integrally attached to shell 30 by means of an extension 48 which projects from the end of the shell and is bent over toward the center of bore 34 to form a gap between extension 48 and center electrode 12.

Figure 2:
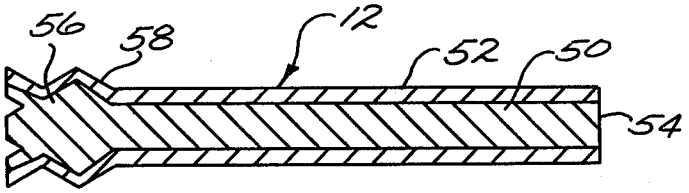
FIG. 2 is an enlarged cross sectional view of the center electrode 12 shown in FIG. 1.

As seen in FIG. 2, in which center electrode 12 is shown in cross section, the electrode is a composite member comprising a core 50 of material particularly well suited for the electrical and corrosion and erosion resistant characteristics desired for spark plug electrodes, such as nickel, or nickel alloys with a sleeve 52 of material disposed thereabout and metallurgically bonded thereto which material is a particularly good thermal conductor, such as copper or copper alloys. A particularly effective copper for this purpose is an oxygen free high electrically conductive copper, or for more corrosion resistance a high electrically and thermally conductive copper alloy. It will be noted that the thickness of sleeve 52 is essentially uniform along the length of the electrode from the tip end 54 up to the head 56. Flange surface 58, conventionally formed as by heading is adapted to be received on seat 26 of body 14 to axially locate electrode 12 so that tip end 54 projects a selected distance from insulator tip 20.

In order to obtain the desired heat transfer characteristic of the composite electrode the sleeve comprises between approximately 10 to 65% and preferably between 20 and 35% of the cross sectional area of the body portion of the composite electrode; that is, between the tip end 54 and head 56.

Electrode 12 is made by metallurgically bonding sleeve 52 to core 50 in order to optimize heat transfer through the interface between the sleeve and core. Preferably sleeve 52 and core 50 are solid phase bonded to one another in a manner known in the art. For example, reference may be had to U.S. Pat. No. 3,355,795 which issued Dec. 5, 1967 to the assignee of the instant invention in which a cylindrical metallic core is clad by metallic sheets of strip form by passage through suitable grooved bending and squeezing rolls. The rolls bend the strips to form half cylinders and bond the strips to each other and to the core in the solid phase by squeezing as set forth in the patent.

During the bonding process, edge fins are formed which project radially from the sheathed core composite. Squeeze rolls of the type disclosed in the patent can be used to sever these edge fins by applying sufficient pressure or separate skiving means can be used if preferred. For most purposes, the composite material is reduced in cross sectional area by the bonding process to a finished diameter of approximately 0.100 inch or slightly less.

Various electrode tip configurations of electrode 12 can be employed. As shown in FIGS. 1 and 2 both core 50 and sleeve 52 project the same distance from body tip 20 to terminate in a flush surface at electrode tip or sparking surface 54. This configuration facilitates the transfer of heat from the sparking surface back into the portions of body 14 in contact with the electrode, as well as drawing the heat away from the insulator tip 20 to permit a cooler operating spark plug. It will be noted that an electrode having a nickel outer jacket and copper core as shown in the prior art referenced above requires a shield to protect the copper from erosion. That is, if the copper core were coextensive in length with the nickel jacket so that the copper were exposed to the combustion gases the copper would tend to erode leaving a rim of nickel which would increase in temperature due to its configuration. However, in the FIGS. 1, 2 embodiment this effect is minimized since it is in effect the rim that is subject to erosion.

Figure 3:
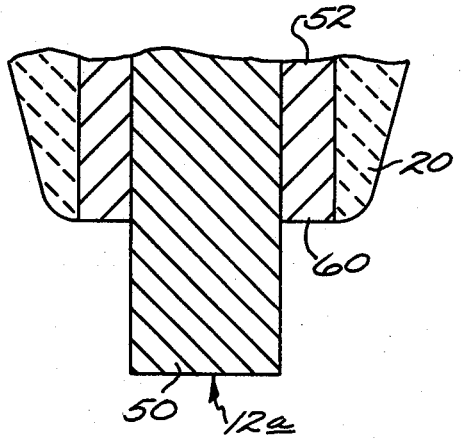
FIGS. 3–7 are fragmentary, enlarged cross sectional views of different center electrode tip configurations.

If it is desired to minimize any corrosion or erosion of copper sleeve 52 it may be desirable to have only core 50 of electrode **12*a* project beyond insulator tip 20 as shown in FIG. 3. Radial surface 60 of sleeve 52** presents a much smaller area of copper exposed to the corrosion atmosphere and whatever corrosion or erosion which did occur would have minimal effect on changes in the heat path from both the insulator tip and the electrode tip to the cylinder head.

Figure 4:
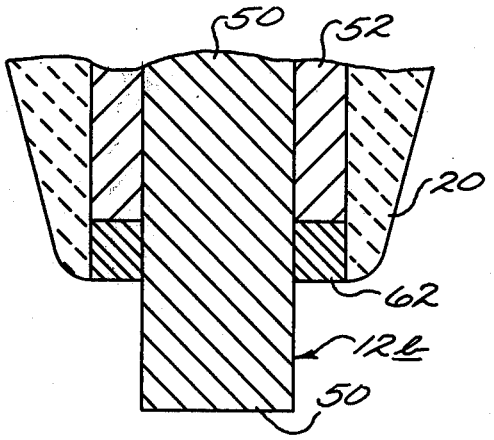
Figure 5:
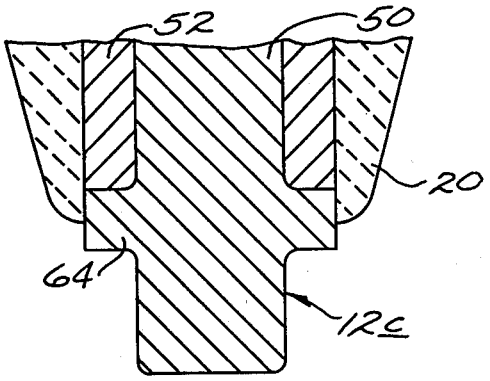

FIG. 4 shows another embodiment in which corrosion of copper sleeve 52 is completely obviated by providing an annular ring 62 of nickel or nickel alloy in electrode **12*b* which can be suitably attached to core 50 as by welding or could be formed integrally with core 50 as seen in electrode 12*c* of FIG. 5 wherein a ring shaped flange 64 is formed on the tip end of electrode 12*c* as by heading operation. It will also be noted that the outer radial surface of ring 62 or flange 64 can be flush with the end of insulator tip 20 (FIG. 4) or can extend beyond the insulator tip 20 (FIG. 5) to provide effective corrosion protection for sleeve 52**.

Figure 6:
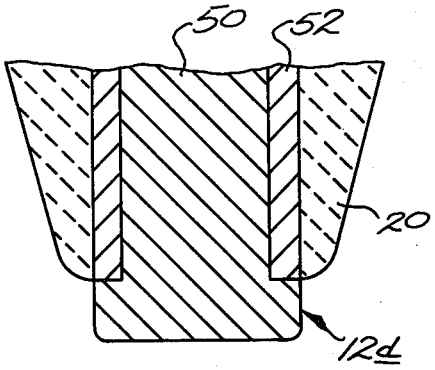
Figure 7:
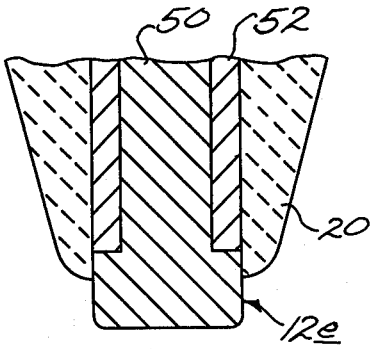

FIGS. 6 and 7 also show electrodes with the core portion headed over with the sealing annular ring and the sparking tip of the electrode having radially extending surfaces which are coplanar to provide corrosion and erosion protection for the copper sleeve 52 with the tip end of the electrode having the same diameter as the outer diameter of copper sleeve 52 and with the radial surface of the copper sleeve either approximately flush with the end of insulator tip 20 (electrode 12*d* of FIG. 6) or set back from the end of insulator tip 20 (electrode 12*e* of FIG. 7).

Additional corrosion and erosion protection of copper sleeve 52 can be provided by coating the outer peripheral surface of electrode 12 with a layer of corrosion and erosion resistant material. This would protect the copper sleeve along its entire length from any corrosion gasses at elevated temperatures which may work their way up the interface between electrode 12 and body 14.

A nickel coating is particularly effective since it resists diffusion into the copper at high temperatures however other materials such as chromium may offer adequate protection for some applications.

Figure 8:
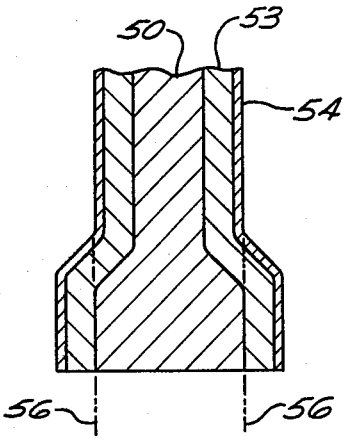
FIG. 8 is an enlarged fragmentary cross sectional view of a partially formed center electrode.
Figure 9:
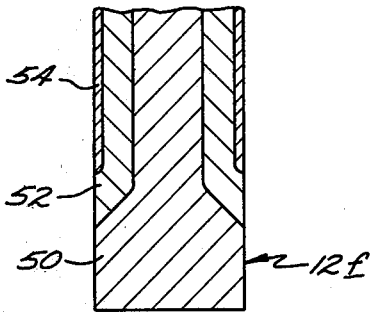
FIG. 9 is a view of the FIG. 8 electrode after forming has been completed.

As seen in FIG. 8 a coating layer 54 is applied to the outer surface of copper sleeve 52 by any suitable process as by a conventional electroplating process. This may conveniently be done in a continuous process after sleeve 52 is bonded to core 50 prior to being cut into discrete electrode lengths. The end of the electrode material is headed over to provide an enlarged end portion of nickel core 50. Excess material is mechanically removed as indicated by dashed lines 56 to result in the electrode configuration 12*f* shown in FIG. 9. Once the excess material is removed along dashed lines 56 a ring of copper is exposed as seen in FIG. 9 and it may be desirable to provide a flash coating of nickel or similar material to prevent corrosion in that limited area.

Figure 10:
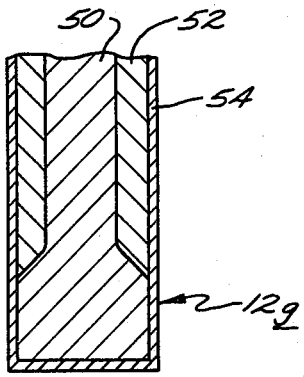
FIG. 10 is a view similar to FIG. 9 of another electrode after forming.

As seen in FIG. 10 the electrode material comprising nickel core 50 and sleeve 52 could be headed over to provide the enlarged nickel end portion and the excess material removed prior to the application of coating 54. This procedure has the advantage of not having an exposed copper ring with which to be concerned.

In order to provide effective protection the coating should be in the order of 0.0001 to 0.003 inch in thickness. Of course as the coatings become thicker, the cost increases and thermal conductivity characteristics of the electrode are affected. For a given coating corrosion and erosion resistance can be optimized by ensuring that the coating is dense. The coating can be densified by conventional techniques such as cold drawing; rolling; shot peening and the like.

Each of the above embodiments has its specific heat path characteristics but all of them have significantly increased surface area at the interface between the electrode material (core) and the heat sink layer (sleeve) which significantly improves the heat transfer characteristics of the electrode relative to the nickel encased copper electrodes of the prior art. The several electrode tip configurations described above offer a variety of features so that different ones can be chosen when the selection criteria differs. For example the FIGS. 1 and 2 embodiment offer particularly excellent heat transfer characteristics but the specific operating temperature of the electrode tip is somewhat more subject to change due to erosion of the sleeve than in the other embodiments. On the other hand, when the copper material sleeve is set back from the tip of the insulator to accommodate a shield the tip of the insulator, as well as the tip of the electrode, will tend to be maintained at a somewhat higher temperature.

As various changes could be made in the above electrode without departing from the scope of the invention, it is intended that all matter contained in the above description or shown in the accompanying drawings shall be interpreted as illustrative and not in a limiting sense.

I claim:

1. A spark plug for use with an internal combustion engine comprising a body of heat resistant, electrically insulative material having first and second ends, a bore extending from the first to the second end, an elongated electrically conductive center electrode member received in the bore and projecting beyond the first end of the body, a generally tubular shaped shell of electrically conductive material adapted to support the body, and a portion of the shell disposed a selected distance from the end of the projecting center electrode member, the center electrode member composed of a core of metal having good erosion and corrosion resistance characteristics, a sleeve of metal having higher heat conductivity than the core metallurgically bonded thereto and a coating of corrosion and erosion resistant material disposed on the outer surface of the sleeve.

2. A spark plug according to claim 1 in which the center electrode member has a head and a tip portion joined by a body portion and the sleeve comprises between approximately 10%-65% of the cross sectional area along the length of the body portion of the center electrode member.

3. A spark plug according to claim 2 in which the sleeve comprises between approximately 20% and 35% of the cross sectional area along the length of the body portion of the center electrode member.

4. A spark plug according to claim 1 in which the sleeve metal is an oxygen free, high electrically conductive copper.

5. A spark plug according to claim 4 in which the core is a nickel alloy.

6. A spark plug according to claim 4 in which the core is nickel.

7. A spark plug electrode member according to claim 1 in which the sleeve and core are coextensive in length.

8. A spark plug according to claim 1 in which the sleeve material is high electrical and thermal conductivity copper alloy.

9. A spark plug according to claim 1 in which the coating material is nickel between 0.0001 and 0.003 inch thick.

10. A spark plug electrode member for use with an internal combustion engine spark plug comprising a core of metal having good spark erosion and corrosion resistance characteristics metallurgically bonded to an outer sleeve of metal having higher heat conductivity than the core, the electrode member having head, tip and body portions, the head portion formed with an annular flange to facilitate mounting with an electrically insulative member, the core and sleeve having generally uniform cross sectional areas substantially along the entire length of the body portion extending from the head to the tip end and a coating of corrosion and erosion resistant material disposed on the outer surface of the sleeve.

11. A spark plug electrode member according to claim 10 in which the coating material is nickel between 0.0001 and 0.003 inch thick.

12. A spark plug electrode member according to claim 10 in which the sleeve comprises between approximately 10%–65% of the cross sectional area along the length of the body portion of the center electrode.

* * * * *